US006393228B2

(12) United States Patent
Hisano

(10) Patent No.: US 6,393,228 B2
(45) Date of Patent: May 21, 2002

(54) TONER AMOUNT MEASURING APPARATUS AND METHOD, AND IMAGE FORMING APPARATUS USING THE SAME

(75) Inventor: Tohru Hisano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/818,580

(22) Filed: Mar. 28, 2001

(30) Foreign Application Priority Data

Mar. 31, 2000 (JP) ..... 2000-097221

(51) Int. Cl.[7] ..... G03G 15/00
(52) U.S. Cl. ..... 399/49; 399/74
(58) Field of Search ..... 399/46, 49, 60, 399/64, 74; 118/688, 690, 691

(56) References Cited

U.S. PATENT DOCUMENTS 5,083,161 A * 1/1992 Borton et al. ..... 399/49
5,253,018 A * 10/1993 Takeuchi et al. ..... 399/49
5,270,784 A * 12/1993 Nakane et al. ..... 399/49
5,761,570 A * 6/1998 Sawayama et al. ..... 399/49
6,061,533 A * 5/2000 Kajiwara ..... 399/49

FOREIGN PATENT DOCUMENTS

JP 6-66722 3/1994

* cited by examiner

*Primary Examiner*—Sandra Brase
(74) *Attorney, Agent, or Firm*—Morgan, Lewis & Bockius LLP

(57) ABSTRACT

A toner amount measuring apparatus includes an irradiating unit which divides a flux of laser beams emitted from a laser diode into two fluxes of laser beams by an obtuse-angled prism and makes the two light fluxes interfere with each other to form interference fringes on a photosensitive roll, and a photodetecting unit including an optical sensor for detecting reflection light obtained by reflecting the light constituting the interference fringes from the photosensitive roll.

15 Claims, 16 Drawing Sheets

TONER AMOUNT MEASURING APPARATUS AND METHOD, AND IMAGE FORMING APPARATUS USING THE SAME

BACKGROUND OF THE INVENTION

1. Field of the Invention

The present invention relates to a toner amount measuring apparatus for optically measuring the amount of toner adhering onto a photosensitive medium or transfer belt of an image forming apparatus such as a printer, a copying machine, a facsimile machine, etc., and an image forming apparatus equipped with a toner amount measuring unit having the same function as the toner amount measuring apparatus.

2. Description of the Related Art

A measurement of a toner amount on a photosensitive medium or transfer belt of an image forming apparatus such as a printer, a copying machine, a facsimile machine or the like plays an important role in controlling an image forming process in the image forming apparatus. Therefore, a toner amount measuring apparatus which optically measures the amount of toner has been well known, and also an image forming apparatus in which a toner amount measuring unit having the same function as the toner amount measuring apparatus is installed to control the image forming process on the basis of a measurement result. In the following description, a carrier for toner which is represented by a photosensitive medium, a transfer belt, etc. is generically referred to as "image forming body"). Further, in the following description, the terms of the toner amount measuring apparatus and the toner amount measuring unit are used with no discrimination at some places.

Next, the construction of a conventional toner amount measuring apparatus will be described with reference to FIGS. 1 to 4.

The image forming bodies such as the photosensitive medium, the transfer belt, etc. to which toner adheres are generally designed to have a mirror surface structure having high flatness, and the toner amount on these image forming bodies has been hitherto measured by utilizing this surface characteristic.

FIG. 1 is a diagram showing the principle of a toner amount measuring apparatus using mirror reflection.

According to the toner amount measuring apparatus using the mirror reflection, light L1 having a predetermined intensity is emitted from a light source 2 such as a light emitting diode (LED) or the like onto the surface of an image forming body 1, and mirror-reflected as reflected light L2 from the surface of the image forming body 1. The reflected light L2 is detected by an optical sensor 3 such as a photodiode or the like, and a voltage having the magnitude corresponding to the intensity of the reflected light L2 thus detected is output from the optical sensor 3.

The reflected light L2 is intercepted by toner particle 4 in a toner-adhering area on the surface of the image forming body 1. Therefore, the light amount of the light L2 which is reflected from the toner-adhering area on the surface of the image forming body 1 and then detected by the optical sensor 3 is reduced by the amount corresponding to the interception of the light L2, and thus the output voltage from the optical sensor 3 is also reduced.

FIG. 2 is a graph showing the relationship between the amount of toner adhering onto the surface of the image forming body 1 and the output voltage of the optical sensor 3 in the toner amount measuring apparatus using the mirror reflection.

The abscissa of the graph of FIG. 2 represents the amount of toner adhering onto the surface of the image forming body, and the ordinate of the graph of FIG. 2 represents the output voltage of the optical sensor.

As described above, the output voltage of the optical sensor corresponds to the light amount of the mirror-reflection light from the surface of the image forming body. As indicated by a curved line 5 which is drawn from the upper left-hand side to the lower right-hand side in the graph, the output voltage of the optical sensor is reduced as the toner adhering amount increases. By determining the curved line 5 in advance, the amount of toner adhering to the surface of the image forming body can be calculated on the basis of the relationship indicated by the curved line 5 and the output voltage of the optical sensor.

When color toner (color toner particles) is used, light used for irradiation of the color toner particles is diffused due to reflections of the light from the surfaces and inner parts of the color toner particles. A toner amount measuring apparatus using such diffused light has been known.

FIG. 3 is a diagram showing the principle of the toner amount measuring apparatus using the diffused light as described above.

In the case of the toner amount measuring apparatus using the diffused light, light L1 having a predetermined intensity is emitted from a light source 2 to the surface of the image forming body 1 as in the case of the toner amount measuring apparatus using the reflected light. However, an optical sensor 6 is disposed at a position out of the travel path of the reflected light L2 shown in FIG. 1. The diffused light L3 caused by the toner particle 4 adhering to the surface of the image forming body 1 is detected by the optical sensor 6, and the voltage corresponding to the intensity of the diffused light L3 thus detected is output from the optical sensor 6.

FIG. 4 is a graph showing the relationship between the toner adhering amount and the output voltage of the optical sensor in the toner amount measuring apparatus using the diffused light.

Like the graph of FIG. 2, the abscissa of the graph of FIG. 4 represents the toner amount, and the ordinate thereof represents the output voltage of the optical sensor. In this case, the output voltage of the optical sensor corresponds to the light amount of the diffused light caused by the toner 4.

As indicated by a curved line 7 in the graph of FIG. 4, the output voltage of the optical sensor increases as the toner adhering amount increases. By determining such a curved line 7 in advance, the amount of toner adhering to the surface of the image forming body can be calculated on the basis of the relationship indicated by the curved line 7 and the output voltage of the optical sensor.

Most of conventional toner amount measuring apparatuses use only one or both of the measuring principles shown in FIGS. 1 and 3, and for example Japanese Patent Laid-open No. Hei-6-66722 discloses one of these toner amount measuring apparatuses.

Here, a target for the toner amount measurement will be described.

FIG. 5 shows a target (object) for the toner amount measurement. In the following description, a toner-amount measurement target in an electrophotographic image forming apparatus will be described.

A toner image is formed according to the procedure described below in the electrophotographic image forming apparatus.

First, the surface of a photosensitive roll 8 rotating in the direction indicated by an arrow F of FIG. 5 is uniformly charged by a bias charging unit 9, and then the surface of the photosensitive roll 8 is irradiated with a laser beam emitted by a laser exposing unit 10 to form an electrostatic latent image. Subsequently, toner adheres to the electrostatic latent image with a developing unit 11 to form a toner image 12. The toner image 12 thus formed is transferred onto a transfer belt 14 by a transferring unit 13 to form a transfer image 15. The transfer image 15 is subsequently transferred to a sheet again, and finally a toner image is formed on the sheet.

The toner image 12 on the photosensitive roll 8 and the transfer image 15 on the transfer belt 14 have been targeted as toner-amount measurement objects, and the amount of toner constituting the toner image 12 and the transfer image 15 is set to about 0.1 to 0.7 mg/cm$^2$. The toner amount in this range can be measured with high precision by using the conventional toner amount measuring apparatuses.

In addition to the toner with which the toner image 12 and the transfer image 15 as described above are formed, a minute amount of toner which induces "fog" or "residual toner" as described later is also particularly targeted as an object on a photosensitive roll 8 or the like on which the toner amount measurement is conducted.

The "fog" is caused by toner which adheres to a background portion to which the toner should be originally avoided from adhering in a process of making the toner adhere to an electrostatic latent image with the developing unit 11 as described above. Therefore, if the amount of toner which induces "fog" is large, the background of an image on a sheet would finally become blackish uniformly or colored.

Next, the "residual toner" 16 will be described.

As described above, the toner image 12 on the photosensitive roll 8 is transferred to the transfer belt 14 to form the transfer image 15. In this transfer process, the transfer efficiency of toner from the photosensitive roll 8 to the transfer belt 14 is not equal to 100%, but equal to about 99% at maximum. This means that a part of the toner constituting the toner image 12 on the photosensitive roll 8 remains on the photosensitive roll 8. The toner remaining on the photosensitive roll 8 means the "residual toner" 16. The "residual toner" 16 is usually removed by a cleaner 17. However, as the toner amount of the "residual toner" 16 increases, cleaning failure occurs and thus image quality is lowered, The toner amount of "fog" and "residual toner" is equal to 0.01 mg/cm$^2$ or less. Accordingly, a toner amount measuring apparatus which measures such a minute amount of toner is required to have such a specification that the measurable range covers a minute toner-amount area from 0.0004 mg/cm$^2$ to 0.01 mg/cm$^2$, and the measuring precision in this toner-amount area is equal to about 0.0004 mg/cm$^2$.

Next, the measuring performance for such a minute toner-amount area in the conventional toner amount measuring apparatus will be described.

FIG. 6 is a graph showing the relationship between the toner amount and the output voltage for a minute toner-amount area in the conventional toner-amount measuring apparatus using the mirror reflection.

The ordinate of the graph of FIG. 6 represents the toner amount of "residual toner". The toner amount of "residual toner" was determined by a method of enlarging toner particles in the minute toner-amount area with a microscope and counting the number of the toner particles or other methods. The abscissa of the graph of FIG. 6 represents a relative output voltage of the toner amount measuring apparatus when the output voltage for the toner amount of "0" is set as a reference value.

From the viewpoint of the overall dynamic range of the optical sensor equipped in the toner amount measuring apparatus, it is indicated that the output voltage of the toner amount measuring apparatus is substantially saturated at a toner amount of about 0.5 mg/cm$^2$. However, paying attention to the relative output voltage as described above, the output voltage is substantially proportional to the toner amount in the minute toner-amount area as indicated by a straight line 18 of the graph shown in FIG. 6. This relationship between the output voltage and the toner amount is obtained by repeating the measurement at many times, and the output voltage data obtained for the minute toner-amount area has a large dispersion as indicated by the distribution of marks 19 which indicate respective measurement results. Therefore, the measurement precision approximately ranges from 0.002 to 0.004 mg/cm$^2$, and thus it is lower than the required measurement precision described above by about one order.

Next, noises in the measurement of a minute amount of toner will be described.

FIGS. 7 to 9 are graphs showing measurement data obtained by using the conventional toner amount measuring apparatus.

These data were obtained by making measurements on the surface of a photosensitive roll rotating at a predetermined rotational frequency. FIG. 7 is a graph showing data under the state that toner was perfectly removed, FIG. 8 is a graph showing data under the state that toner adhered to the surface of the photosensitive roll and FIG. 9 is a graph showing the difference between the data of FIG. 7 and the data of FIG. 8. The abscissas in FIGS. 7 to 9 represent the time, and the ordinates in FIGS. 7 to 9 represent the output voltage.

Waviness 20 having a large period which exists on the graphs of FIGS. 7 and 8 corresponds to a stationary variation which is caused by dispersion in the surface shape or reflectivity of the photosensitive roll. Further, a large number of fine peaks 21 occur on the graphs of FIGS. 7 and 8. These peaks are caused by electromagnetic noises occurring in the image forming apparatus, and a high-voltage source and a bias charging unit may be considered as sources which generate these electromagnetic noises.

An upper line 22 of two fine lines 22, 23 in FIG. 9 indicates data obtained by subjecting the data of FIG. 7 to 25-times movement average processing to remove the peaks 21 based on the electromagnetic noises. Likewise, the lower line 23 of the two fine lines 22, 23 indicates data obtained on the basis of the data of FIG. 8.

A heavy line 24 of FIG. 9 indicates data by matching the phase between the data indicated by the fine lines 22, 23 and then conducting subtraction processing on the data thus phase-matched, and peaks 25 appear at toner-adhering portions.

The height of the peak 25 has sufficient reproducibility for the same measurement target. However, when the measurement target is varied, the peak height is varied even for the same toner amount, and thus it has a large dispersion between data. Therefore, it is difficult to achieve the measurement precision in the specification required as described above.

As described above, with respect to the conventional toner amount measuring apparatus, it is difficult to control the image forming conditions by measuring "fog" and "residual toner" with the conventional toner amount measuring apparatus because the measurement precision for the minute toner-amount area is low.

Further, when the toner amount of "fog" or "residual toner" is required to be measured in the developing process of an image forming apparatus, there has been hitherto used such a method that the image forming apparatus is stopped to detach from the image forming apparatus a photosensitive roll to which toner of "fog" or "residual toner" adheres, and then the toner is enlarged with a microscope or the like to count the number of toner particles. However, the measurement of the toner amount by using this method needs a large number of steps to merely perform the measurement, and much developing time and a high developing cost are needed for the image forming apparatus.

SUMMARY OF THE INVENTION

The present invention has been made in view of the above circumstances, and provides a toner amount measuring apparatus which can measure a minute amount of toner inducing "residual toner" and "fog" with high precision, and an image forming apparatus equipped with a toner amount measuring unit having the same function as the toner amount measuring apparatus to thereby form a high-quality image.

According to an aspect of the present invention, a toner amount measuring apparatus which detects reflection light reflected from an image forming body carrying toner to measure the amount of the toner carried on the image forming body, is characterized by including: an irradiating unit which irradiates the image forming body with light to form fringes of light on the image forming body; and a photodetecting unit which detects reflection light obtained by reflecting the light forming the fringes from the image forming body.

Further, according to another aspect of the present invention, an image forming apparatus which finally forms a toner image on a sheet under a controllable image forming condition, is characterized by including: an image forming body which carries toner to form the toner image; a toner amount measuring unit which is equipped with an irradiating unit for irradiating the image forming body with light to form fringes of light on the image forming body and a photodetecting unit for detecting reflection light obtained by reflecting the light forming the fringes from the image forming body, and measures the amount of toner carried on the image forming body; and a condition controlling unit for controlling the image forming condition on the basis of the toner amount measured by the toner amount measuring unit.

According to another aspect of the present invention, a toner amount measuring method has the steps of: irradiating an image forming body with light to form fringes of light thereon; detecting the light forming the fringes reflected from the image forming body and outputting a photodetection signal in accordance with the amount of the light thus detected; and extracting a signal component having a specific frequency from the photodetection signal.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Preferred embodiments according to the present invention will be described hereunder with reference to the accompanying drawings.

A toner amount measuring apparatus of the present invention has an irradiating unit for irradiating an image forming body with light to form fringes of light on the image forming body, and a photodetecting unit for detecting reflection light reflected from the surface of the image forming body. The toner amount measuring apparatus of the present invention is typically designed to measure the toner amount on the image forming body which is moved in a predetermined direction while carrying the toner. In such a typical toner amount measuring apparatus, the irradiating unit forms fringes of light crossing the predetermined direction on the image forming body. The photodetecting unit outputs a photodetection signal whose magnitude corresponds to the light amount of the detected reflection light, and is equipped with an extracting unit for extracting a signal component having a predetermined frequency from the photodetection signal output from the photodetecting unit.

Figure 1:
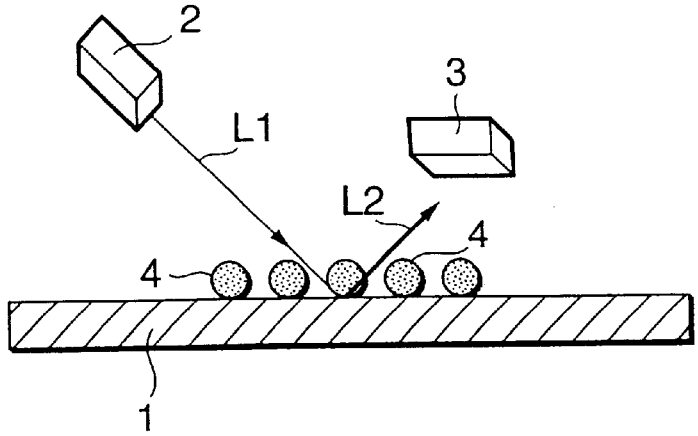
FIG.1 CONVENTIONAL ART
FIG. 1 is a diagram showing the measuring principle of a toner amount measuring apparatus utilizing mirror reflection.
Figure 2:
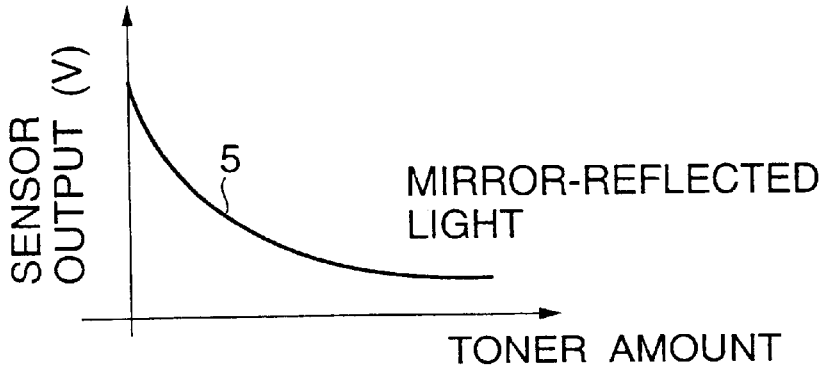
FIG.2 CONVENTIONAL ART
FIG. 2 is a graph showing the relationship between the adherence amount of toner and the output voltage of an optical sensor in the toner amount measuring apparatus using mirror reflection.
Figure 3:
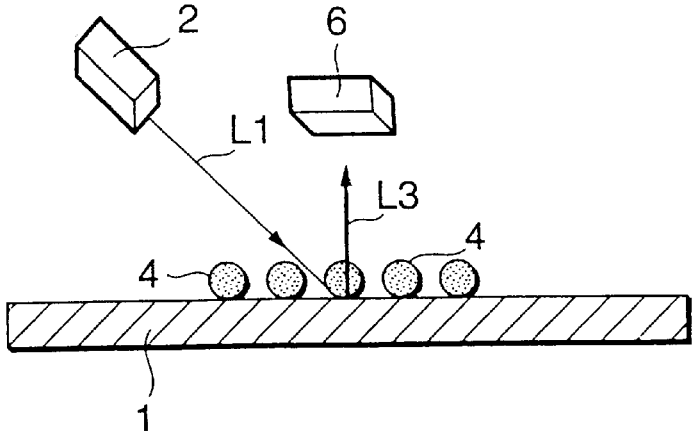
FIG.3 CONVENTIONAL ART
FIG. 3 is a diagram showing the measuring principle of a toner amount measuring apparatus using diffused light.
Figure 4:
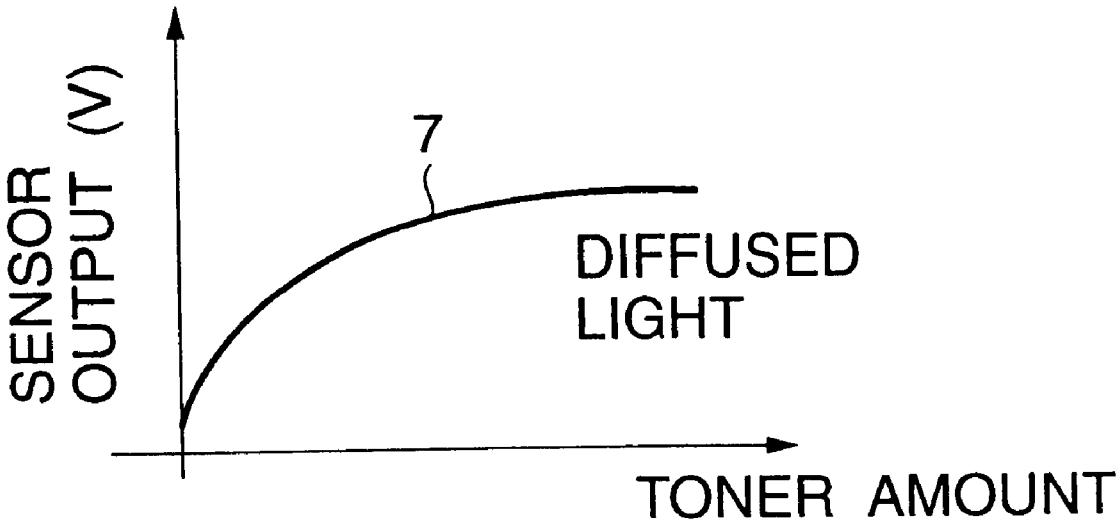
CONVENTIONAL ART FIG.4
FIG. 4 is a graph showing the relationship between the adherence amount of toner and the output voltage of an optical sensor in the toner amount measuring apparatus using the diffused light.
Figure 5:
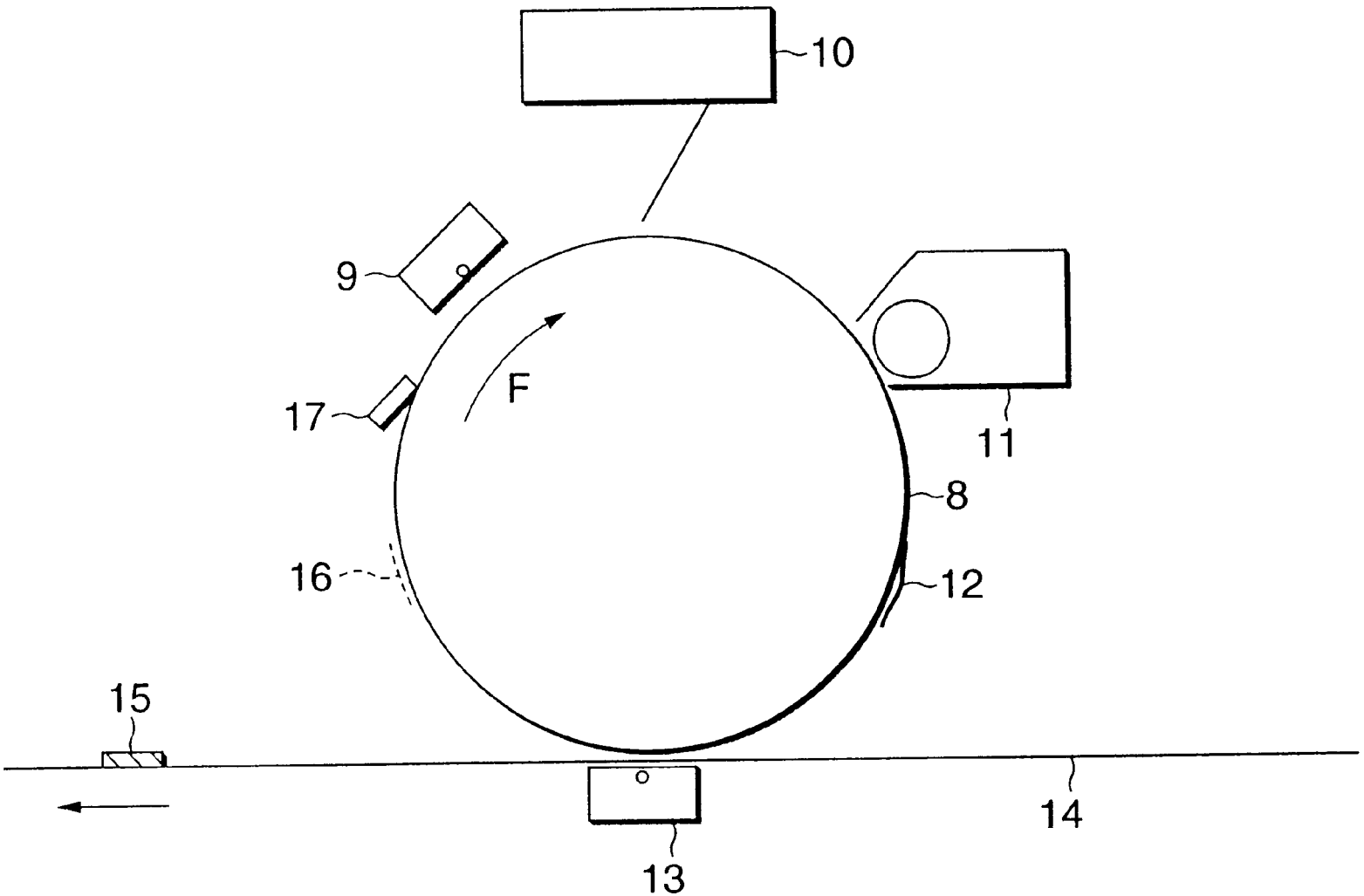
FIG.5 CONVENTIONAL ART
FIG. 5 is a diagram showing a target for the toner amount measurement.
Figure 6:
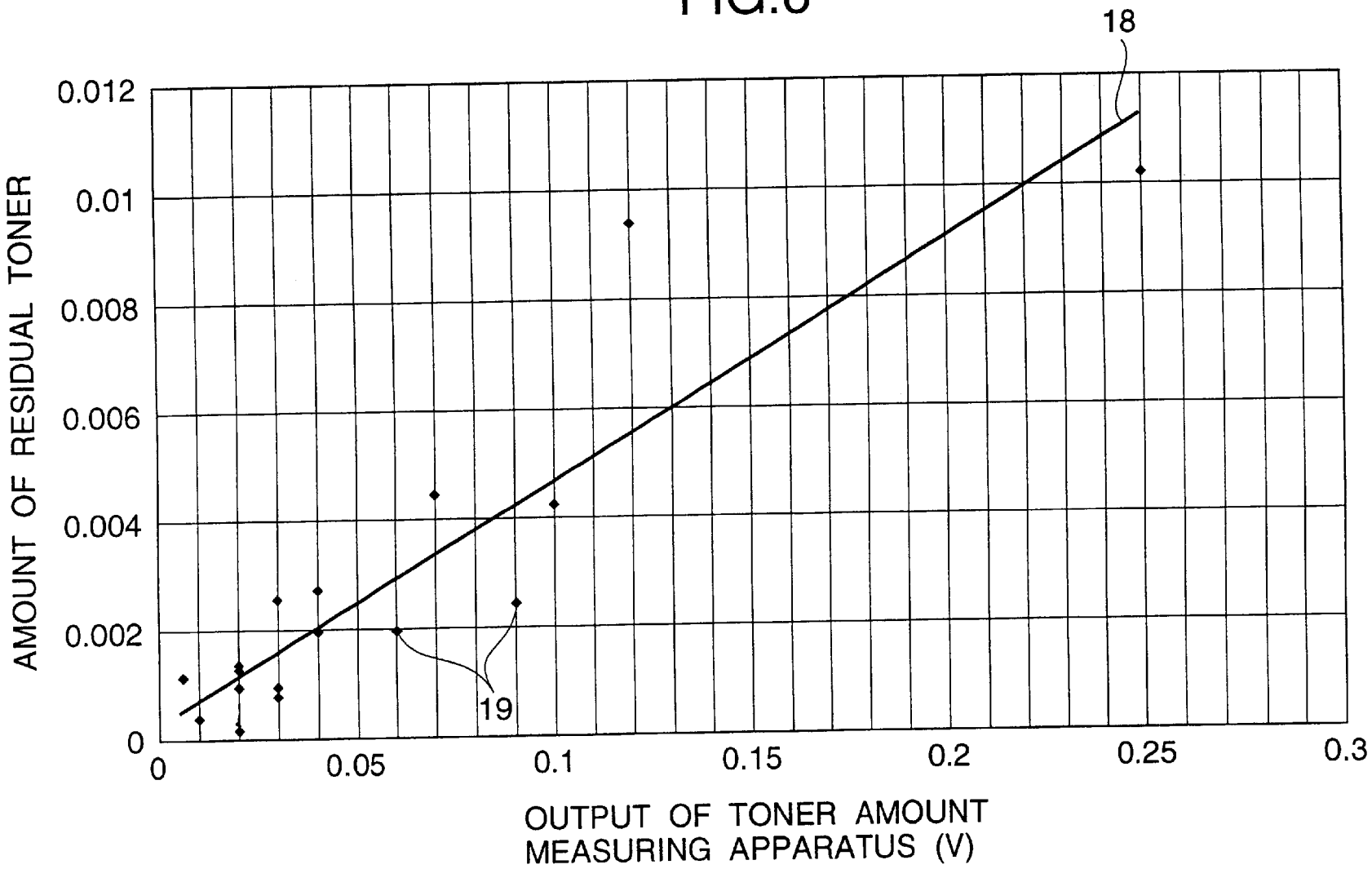
CONVENTIONAL ART FIG.6
FIG. 6 is a graph showing the relationship between the toner amount and the output voltage in the conventional toner amount measuring apparatus using the mirror reflection for a minute toner-amount area.
Figure 7:
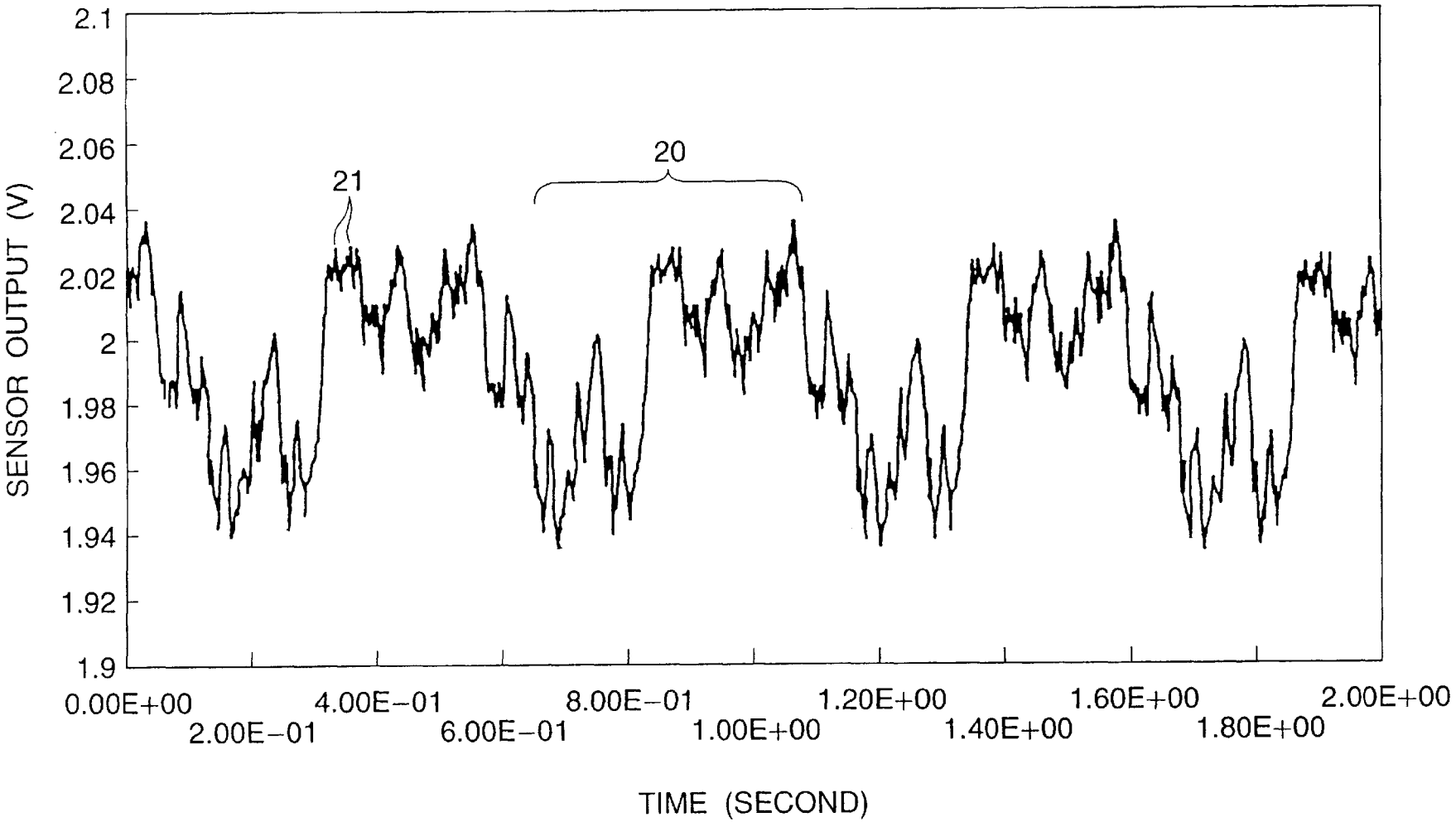
FIG.7 CONVENTIONAL ART
FIG. 7 is a graph showing data when toner is perfectly removed.
Figure 8:
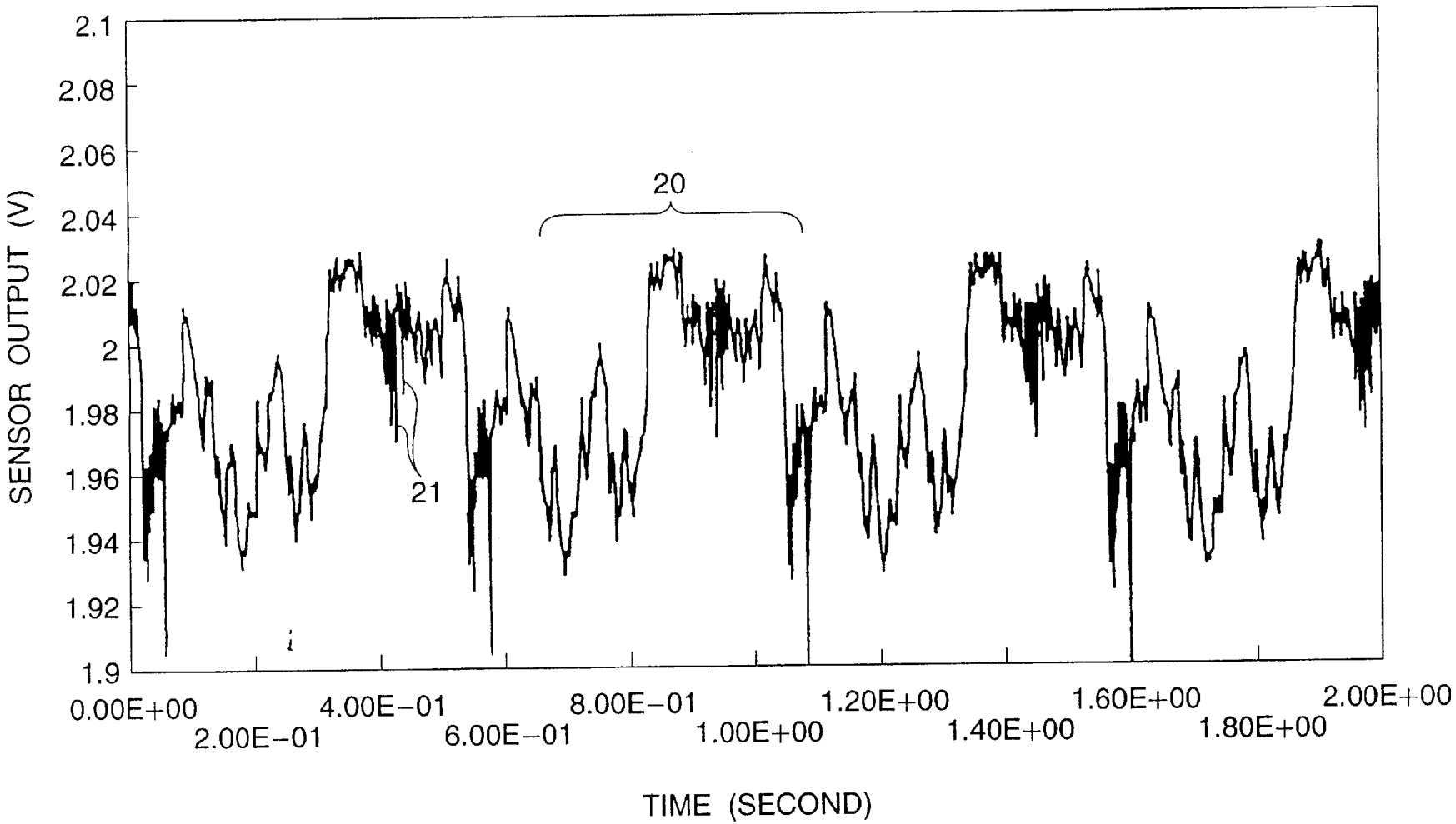
FIG.8 CONVENTIONAL ART
FIG. 8 is a graph showing data when toner adheres.
Figure 9:
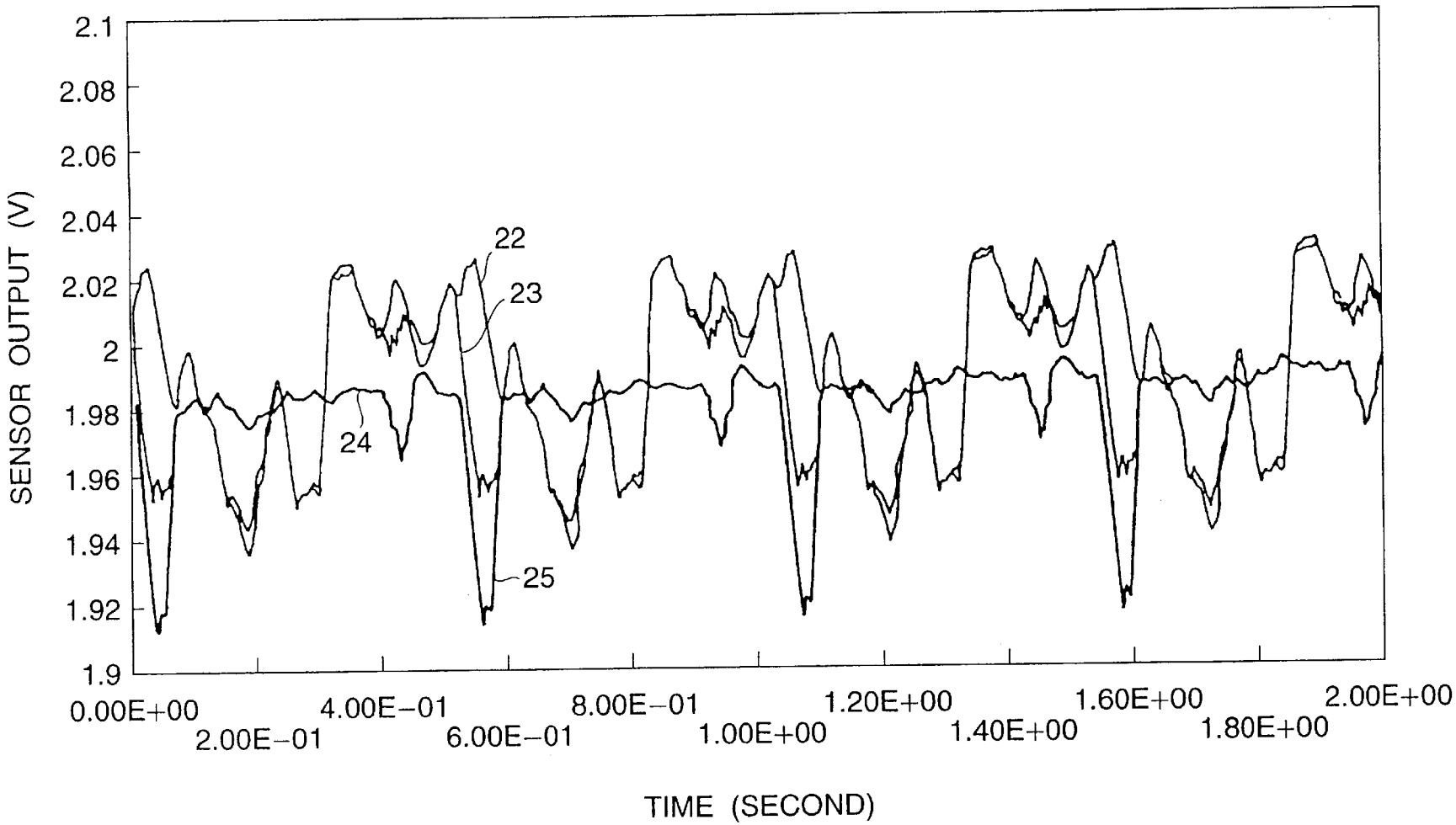
FIG.9 CONVENTIONAL ART
FIG. 9 is a graph showing the difference between the data of FIG. 7 and the data of FIG. 8.
Figure 10:
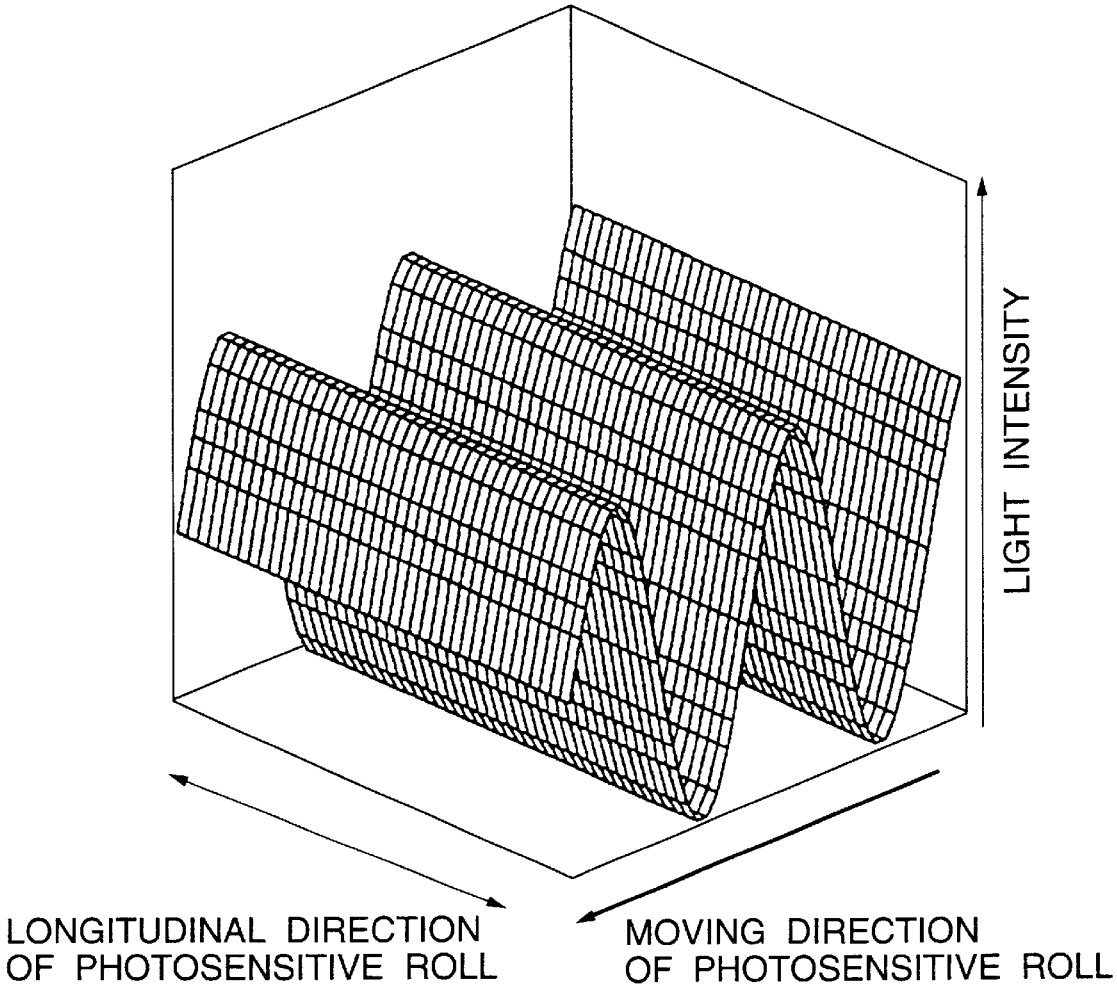
FIG. 10 is a graph showing fringes of light formed on the surface of the image forming body.

FIG. 10 is a graph showing the fringes of light formed on the surface of the image forming body.

In this case, the description will be made on the assumption that the fringes of light are formed on the photosensitive roll described above.

In FIG. 10, the light amount distribution (profile) of the fringes of light which are formed on the photosensitive roll by the irradiating unit is three-dimensionally drawn on the graph. As is apparent from the graph, the light amount does not vary in the longitudinal direction of the photosensitive roll, but it varies like a sine wave in the moving direction of the peripheral surface of the photosensitive roll. That is, the fringes of light formed on the photosensitive roll are perpendicular to the moving direction of the peripheral surface of the photosensitive roll.

These fringes of light could be easily and accurately formed if the irradiating unit is designed to form interference fringes as the fringes of light. Further, as a matter of course, these fringes of light may be formed at only a site which is targeted as a toner-amount measurement area on the surface of the photosensitive roll.

The toner particles adhering onto the photosensitive roll pass through the fringes of light while the peripheral surface of the photosensitive roll is moved, and periodically impinge against the bright portions of the fringes of light. As a result, the light of the fringes is periodically intercepted by the toner particles, and thus a light component whose light amount is increased/reduced periodically is superposed on the reflection light obtained through the reflection of the fringes of light from the surface of the photosensitive roll. As the toner amount increases, the light component having such periodicity is increased. The toner amount measuring apparatus of the present invention measures the toner amount by using the light component having such periodicity.

It is preferable that the pitch of the interference fringes is sufficiently larger than the diameter of the toner particles. For example, when the diameter of toner particles is equal to 5 $\mu$m, the pitch of the interference fringes is preferably four times or more as large as the diameter of the toner particles, that is, 20 $\mu$m. Conversely, if the pitch of the interference fringes is less than four times of the diameter of the toner particles, the contrast between light and dark patterns in the interference fringes of light is buried within the diameter of the toner particles, so that the increase/reduction in light amount is insufficient and thus the measuring precision is lowered.

Here, the increase/reduction of the light amount of the reflection light when one toner particle passes through the fringes of light having a light amount distribution (profile) shown in the graph of FIG. 10 will be described.

Figure 11:
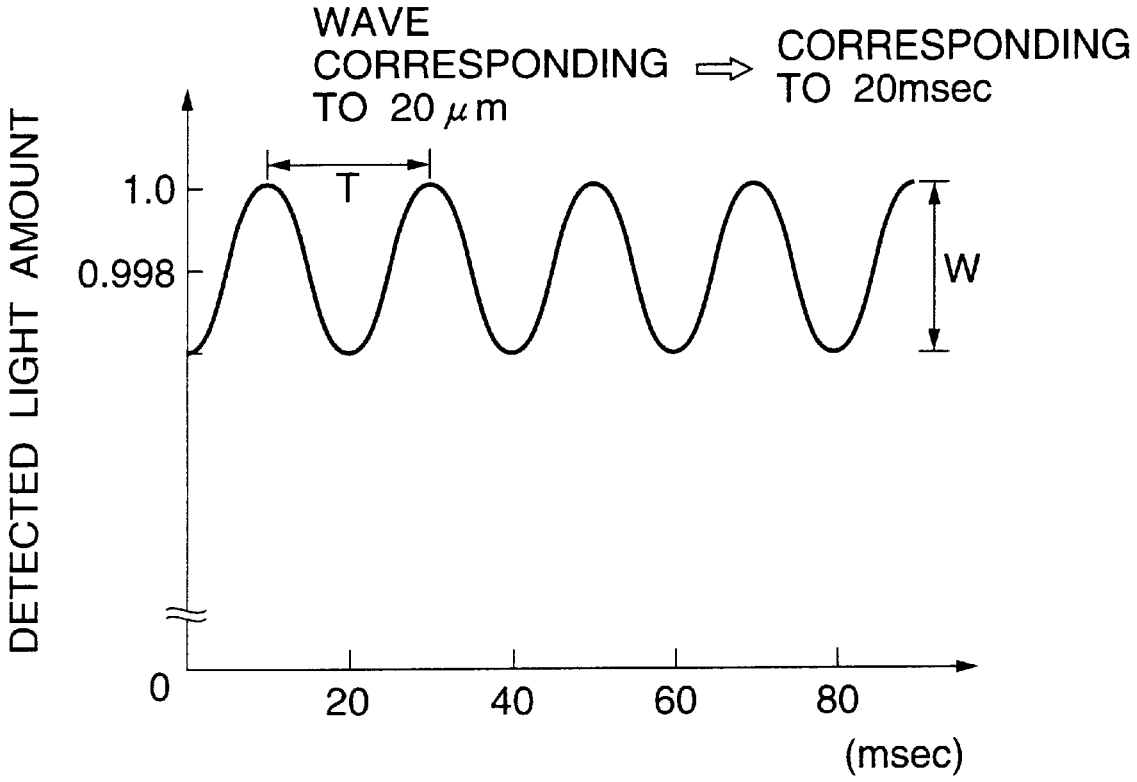
FIG. 11 is a graph showing increase/reduction of reflection light when a toner particle passes through the fringes of light.

FIG. 11 is a graph showing the increase/reduction of the light amount of the reflection light when one toner particle passes through the fringes of light, and the ordinate of the graph represents the light amount while the abscissa of the graph represents the time.

The toner particle passes through the fringes of light at a predetermined speed while the peripheral surface of the photosensitive roll is moved. In this case, the increase/reduction of the light amount is measured under the following conditions:

(1) the fringes of light are formed as interference fringes having a pitch of 20 $\mu$m in a square area of 1 mm×1 mm;

(2) the light amount of the reflection light which is detected by the photodetecting unit when no toner exists on the photosensitive roll is set to 1 mW;

(3) the toner particle is designed as a sphere having a diameter of 5 $\mu$m; and (4) the moving speed of the peripheral surface of the photosensitive roll is equal to 1 mm/sec.

The toner particle of 5 $\mu$m in diameter has a projection area of $1.96\times10^{-11}$ m$^2$, and has an area occupation rate of $1.96\times10^{-3}$% in an area of 1 mm$^2$. When the toner particle exists in the area of 1 mm$^2$ which is irradiated with uniform light having a total light amount of 1 mW from the vertical direction, the light amount is simply reduced in accordance with the area occupation rate. Therefore, the reflection light of $1-1.96\times10^{-3}=0.99804$ mW is detected by the photodetecting unit.

When the toner particle passes through the area in which the interference fringes are formed, the interference fringes of light is periodically intercepted by the toner particle, and the increase/reduction of the light amount detected occurs. The period of the increase/reduction of the light amount is determined by the wavelength of the interference fringes and the moving speed of the toner particle (that is, the moving speed of the peripheral surface of the photosensitive roll). Under the above condition, the period of the increase/reduction of the light amount is equal to 50 kHz. The amplitude of the increase/reduction of the light amount which occurs due to the passage of the toner particle through the interference fringes is twice as high as that of the uniform light, and thus it is equal to $1.96\times10^{-3}\times2=3.92\times10^{-3}$ mW. The light component whose light amount is increased/reduced as described above is superposed on the reflection light of 0.99804 mW on average.

Finally, when one toner particle passes through the interference fringes of light, the light amount whose light amount is increased/reduced in the form of a sine wave having a period T of 20 msec and an amplitude W of about 0.004 mW as shown in the graph of FIG. 11 is detected by the photodetecting unit. Further, when plural toner particles pass through the interference fringes of light, plural light components whose light amount is increased/reduced as shown in the graph of FIG. 11 are superposed on the reflection light of 0.99804 mW on average, and detected by the photodetecting unit. For example, the toner amount of 0.0004 mg/cm$^2$ is substantially equal to fifty toner particles having the above diameter. When fifty toner particles randomly pass through the interference fringes of light, fifty light components each of which has a light amount varying as shown in the graph of FIG. 11 are superposed on one another with being randomly displaced in the range from 0 to 20 $\mu$m in phase, and the reflection light containing the light components thus superposed is detected by the photodetecting unit.

The photodetecting unit outputs a photodetection signal in accordance with the detected light whose light amount is periodically increased/reduced, and a signal component having the frequency corresponding to the above period is extracted from the photodetection signal by an extracting unit, whereby the signal component corresponding to the toner amount and noises are separated from each other and thus the toner amount is measured with high precision. As an extraction method of the extracting unit may be used a frequency analysis method such as Fast Fourier Transform or the like, a simple filtering method or the like.

Figure 12:
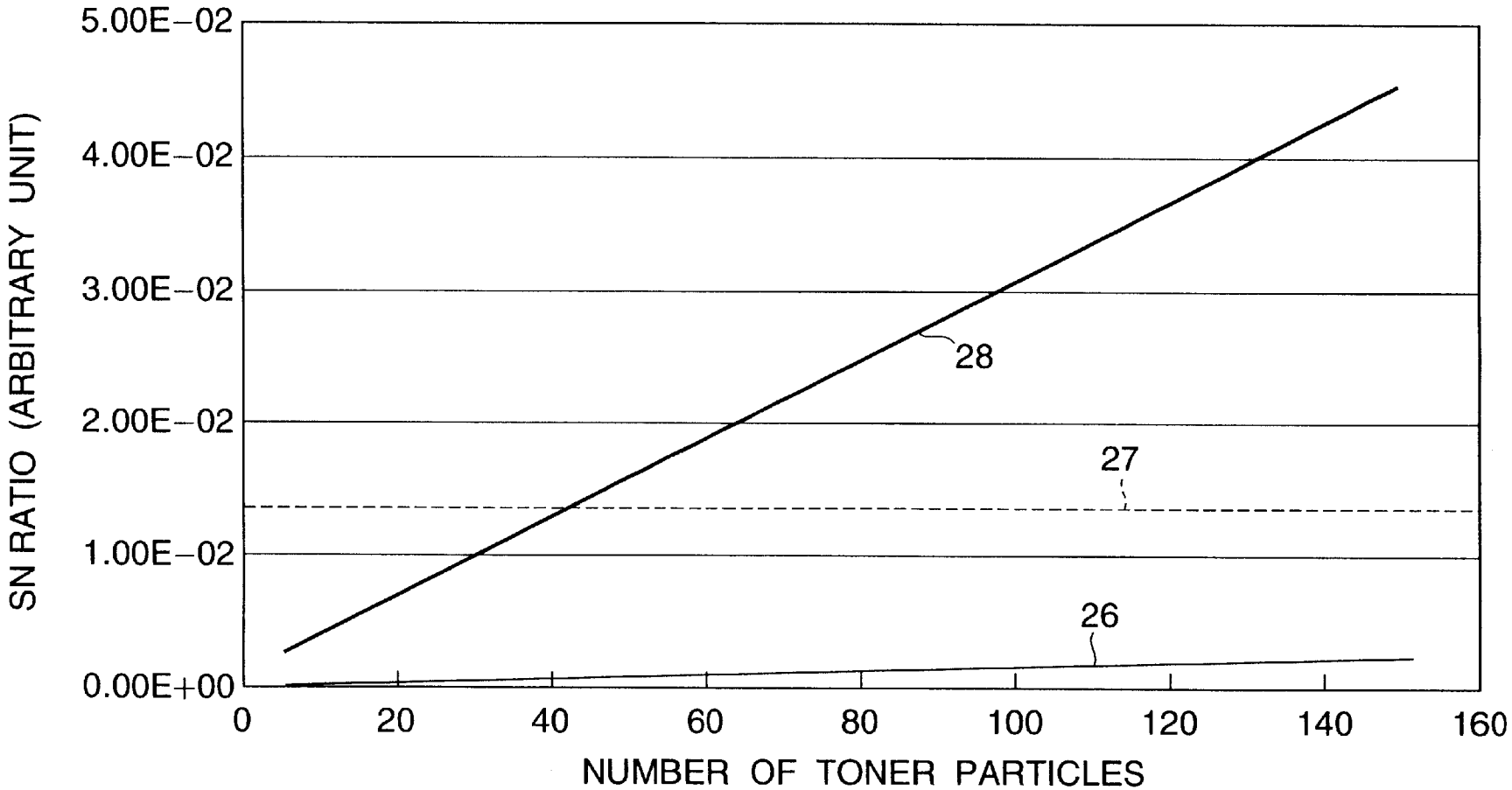
FIG. 12 is a diagram showing comparison results in measuring capability between the toner amount measuring apparatus of the present invention and the conventional toner amount measuring apparatus.

FIG. 12 is a diagram showing the comparison result in measuring performance between the toner amount measuring apparatus of the present invention and the conventional toner amount measuring apparatus.

In this comparison test, SN ratio is used as an index to indicate the measuring performance of each of the toner amount measuring apparatus and the conventional toner amount measuring apparatus. The abscissa of FIG. 12 represents the number of toner particles, and the ordinate of FIG. 12 represents SN ratio (unit is arbitrary).

A gently-sloping line 26 of FIG. 12 represents the SN ratio for the conventional toner amount measuring apparatus. The SN ratio indicated by the gently-sloping line 26 is still lower than the permissible level 27 required for the toner amount measurement due to the noises as described above. On the other hand, a sharply-sloping line 28 of FIG. 12 represents the SN ratio for the toner amount measuring apparatus of the present invention. As described above, the signal component corresponding to the toner amount and the noises are separated from one another, so that the SN ration exceeds the permissible level 27 with toner particles whose number is equal to about 50.

As described above, according to the toner amount measuring apparatus of the present invention, a minute amount of toner which causes "residual toner" or "fog" can be measured with high precision. Further, the toner amount of a toner image which is formed with a large amount of toner can be also measured by using the toner amount measuring apparatus of the present invention, and when the toner amount of such a toner image is measured, it is unnecessary to extract the signal component by using the extracting unit.

The description on the principle of the present invention is just completed, and next preferred embodiments of the present invention will be described hereunder. In the following description, a printer using laser exposure will be described as an embodiment of the image forming apparatus.

Figure 13:
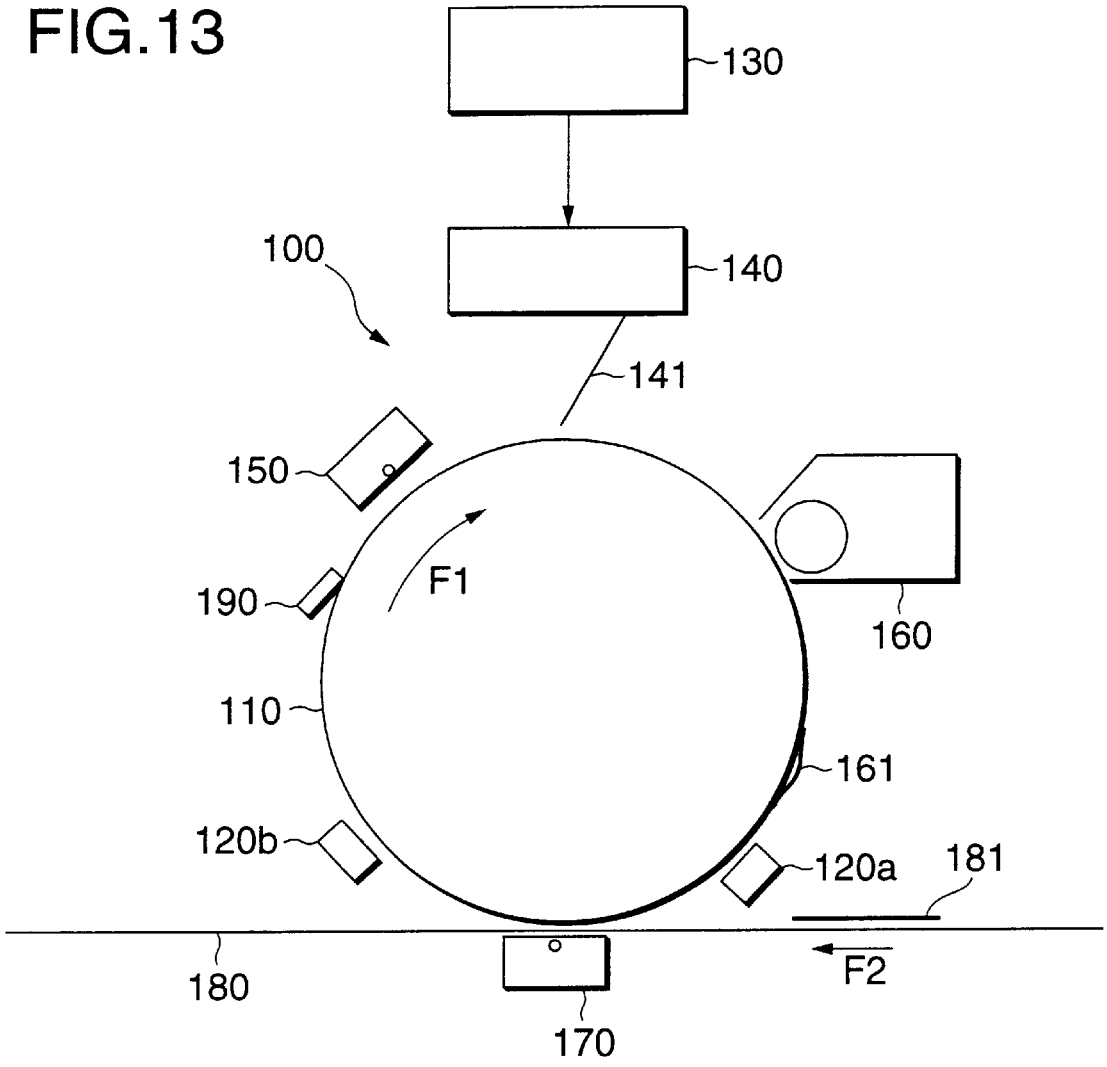
FIG. 13 is a diagram showing a printer which is an embodiment of the image forming apparatus according to the present invention.

FIG. 13 is a diagram showing the construction of a printer which is an embodiment of the image forming apparatus according to the present invention.

The printer 100 finally forms a toner image on a sheet under a controllable image forming condition, and it is equipped with a photosensitive roll 110 serving as an example of the image forming body of the present invention, toner amount measuring units 120*a,* 120*b* for measuring the amount of toner on the photosensitive roll 110, and a controller 130 for controlling the image forming condition on the basis of the toner amount measured by the toner amount measuring units 120*a,* 120*b*. Each of the toner amount measuring units 120*a,* 120*b* is an embodiment of the toner amount measuring apparatus of the present invention, and also an embodiment of the toner amount measuring unit of the present invention. Further, the controller 130 is an embodiment of the condition controlling unit of the present invention.

The photosensitive roll 110 is covered with photosensitive material on the surface thereof, and it is rotated in the direction of an arrow F1 at a predetermined rotational frequency.

The controller 130 generates a laser turn-on signal on the basis of an image signal transmitted from a computer or the like and the measurement results obtained by the toner amount measuring units 120*a,* 120*b,* and then outputs the laser turn-on signal thus generated to a laser exposing unit 140.

On the basis of the laser turn-on signal, the laser exposing unit 140 irradiates the surface of the photosensitive roll 110 which is uniformly charged by a bias charging unit 150 with a laser beam 141, and varies the surface potential of the photosensitive roll 110 to form an invisible electrostatic latent image on the surface of the photosensitive roll 110.

A developing unit 160 selectively attaches toner to the electrostatic latent image to form a visualized developed toner image 161 from the electrostatic latent image. The toner amount measuring unit 120*a* measures the amount of toner constituting the developed toner image 161 and also the amount of toner inducing "fog" which occurs on the background of the developed toner image 161.

A transferring unit 170 transfers the developed toner image 161 on the photosensitive roll 110 onto a sheet 181 which has been just fed in the direction of an arrow F2 by a feeding belt 180, thereby forming a transferred toner image on the sheet 181. The transferred toner image formed on the sheet as described above is fixed by a fixing unit (not shown) and then the sheet having the transferred toner image is fed to the outside of the printer 100.

The toner amount measuring unit 120*b* measures the toner amount of "residual toner" formed of toner which could not be transferred onto the sheet by the transferring unit 170. A cleaner 190 removes the "residual toner".

As described above, the toner amount measuring units 120*a,* 120*b* measure the toner amount of the developed toner image 161, the toner amount of "fog" and the toner amount of "residual toner" during the process of forming the toner image. The controller 130 controls the charging unit 150, the laser exposing unit 140, the developing unit 160, the transferring unit 170, etc. on the basis of the measurement values of the toner amount if occasion demands.

In the following description, the toner amount measuring unit 120*a* of the two toner amount measuring units 120*a,* 120*b* will be representatively described in detail.

Figure 14:
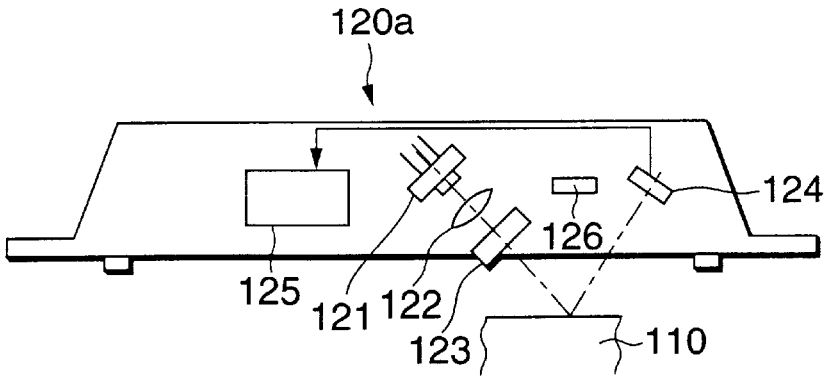
FIG. 14 is a diagram showing the construction of a toner amount measuring unit.

FIG. 14 is a diagram showing the construction of the toner amount measuring unit 120*a.*

The toner amount measuring unit 120*a* is equipped with a laser diode 121 for emitting laser beams, which is an example of the laser beam source of the present invention, a collimating lens 122 for collimating a flux of laser beams emitted from the laser diode 121 into a flux of collimated laser beams, an obtuse-angled prism 123 for forming interference fringes on the photosensitive roll 110 with using the laser beams collimated by the collimating lens 122 as described later, and a first optical sensor 124 for detecting reflection light which is obtained by the mirror-reflection of the light contributing to the interference fringes from the surface of the photosensitive roll 110. The laser diode 121, the collimating lens 122 and the obtuse-angled prism 123 constitute an example of the irradiating unit of the present invention. The irradiating unit is equipped with an obtuse-angled prism having two refractivesurfaces which are disposed to be adjacent to each other through a ridgeline in a convex shape (e.g., inverse V shape), and a laser beam source for emitting laser beams, and divides a flux of laser beams emitted from the laser beam source into two fluxes of laser beams by the ridgeline of the obtuse-angled prism and refracts the two fluxes of laser beams by the two refractive surfaces between which the ridgeline exists, whereby these two fluxes of laser beams interfere with each other. The interference of the fluxes of laser beams with the obtuse-angled prism 123 will be described later. The first optical sensor 124 constitutes an example of the photodetecting unit of the present invention.

The irradiating unit of the toner amount measuring unit 120*a* forms the interference fringes as the fringes of light on the photosensitive roll. In order to form the interference fringes, it is required to fabricate a system in which a light source for generating light having high coherence and an optical element for establishing an interference state are combined. In this case, the laser diode 121 is selected as the light source, and the obtuse-angled prism 123 is selected as the optical element. The laser diode 121 is suitably used as the light source from the viewpoint that it is low in price and it is easily added with a circuit for stabilizing the light amount of the laser beams because it usually contains a photodiode for monitoring the light amount. In some cases, the optical fatigue of the photosensitive material on the surface of the photosensitive roll 110 causes a problem. Therefore, the wavelength and light amount of the laser diode 121 must be selected in conformity with the specification of the photosensitive roll 110.

The toner amount measuring unit 120*a* is equipped with an analysis circuit 125 for subjecting the output signal of the first optical sensor 124 to the frequency analysis to extract a signal component having a predetermined frequency described above. The analysis circuit 125 is an example of the extracting unit of the present invention.

Furthermore, the toner amount measuring unit 120*a* is further equipped with a second optical sensor 126 for detecting diffused light which is caused by diffusing of light contributing to the interference fringes formed on the photosensitive roll 110 with toner particles. The second optical sensor 126 is not indispensable for the toner amount measuring unit of the present invention, however, it is effectively used for the toner amount measurements when the toner amount is large.

The output signal of the analysis circuit 125 and the output signal of the second optical sensor 126 are input to the controller 130 shown in FIG. 13. The controller 130 selectively and discriminatively uses each of these output signals to measure the toner amount of the developed toner image 161 shown in FIG. 14, the toner amount of "residual toner" occurring in the transfer operation of the developed toner image 161 and the toner amount of "fog" occurring on the background of the developed toner image 161 with high precision. The controller 130 controls the image forming condition on the basis of the measuring result to form a high-quality image.

Figure 15A:
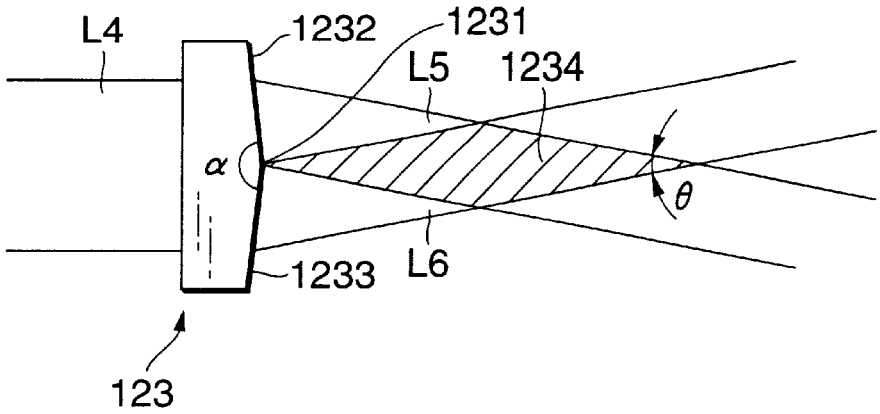
FIGS. 15A and 15B are side view and perspective view of an obtuse-angled prism, respectively.
Figure 15B:
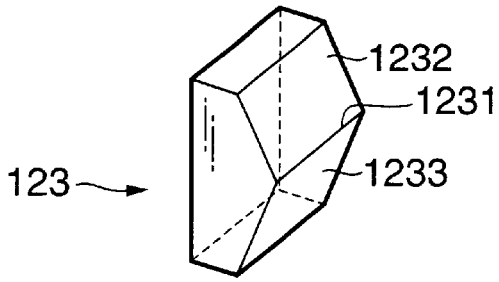

FIGS. 15A and 15B are side and perspective views of the obtuse-angled prism.

The obtuse-angled prism 123 has two refractive surfaces 1232 and 1233 which are disposed to be adjacent to each other through a ridgeline 1231 and form a convex shape (inverse V shape) having an apex angle of $\alpha$. When laser beams L4 are incident to the obtuse-angled prism 123, the flux of laser beams L4 is divided by the ridgeline of the obtuse-angled prism and then the respective fluxes of light beams L5 and L6 thus divided are refracted by the two refractive surfaces 1232, 1233 so as to cross each other at a predetermined angle of $\theta$. The two fluxes of light beams L5 and L6 interfere with each other to form interference fringes in the area 1234 where these light fluxes L5, L6 cross each other. The pitch P of the interference fringes is represented by the following equation: $P=\lambda/\sin(\theta/2)$, where $\lambda$ represents the wavelength of the laser beams L4 and $\theta$ represents the cross angle between the light fluxes L5, L6.

Here, the apex angle $\alpha$ of the obtuse-angled prism 123 is calculated on the assumption that the obtuse-angled prism 123 using BK7 as glass material forms interference fringes of 20 $\mu$m in pitch. The apex angle $\alpha$ of the obtuse-angled prism 123, the refractive index n of the obtuse-angled prism 123 and the cross angle $\theta$ of the light beam fluxes L5, L6 satisfy the following relationship:

$$\theta=(n-1)\cdot(180^\circ-\alpha)/2$$

BK7 has a refractive index n=1.511 to light having a wavelength of 786 nm. If the wavelength of the laser beams L4 is equal to 780 nm, the apex angle $\alpha$ of the obtuse-angled prism 123 is equal to 171.2°. The apex angle $\alpha$ of the obtuse-angled prism 123 is preferably set to a value in the range from 160 degrees to 179 degrees. By using the obtuse-angled prism 123 which is designed to have the above specification, the interference fringes having a pitch of 20 $\mu$m as described above can be easily formed, and the toner amount measurement having high precision can be implemented. If it is required to change the pitch of the interference fringes, the pitch of the interference fringes can be easily changed by replacing the obtuse-angled prism being used with one having a different apex angle or using different glass material.

Here, modifications of the irradiating unit of the present invention will be described.

In the irradiating unit of the embodiment shown in FIG. 14, the interference fringes are formed by the obtuse-angled prism 123. However, the irradiating unit of the present invention is not limited to an element for forming interference fringes, and any element may be used insofar as it forms fringes in which light and dark patterns of light are arranged at equal intervals.

Figure 16:
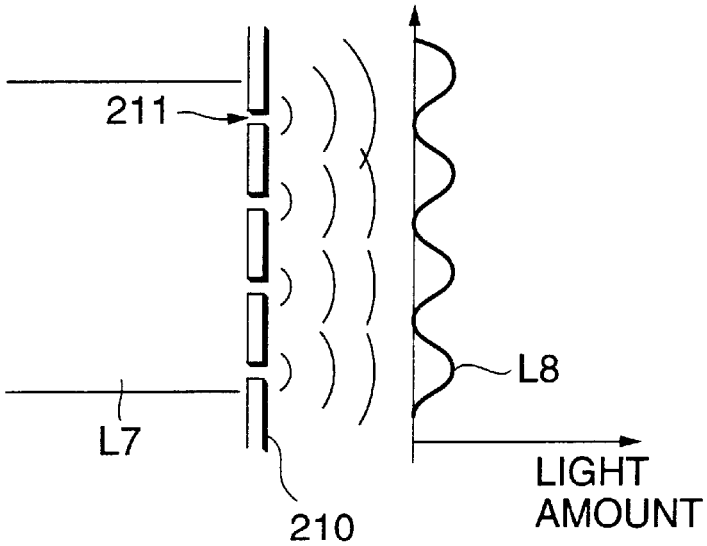
FIG. 16 is a diagram showing a first modification.

FIG. 16 is a diagram showing a first modification of the irradiating unit.

The first modification of the irradiating unit has a light source for emitting light L7 having high coherence, and a ladder slit 210 having plural striped openings 211 which are arranged with high precision.

When the tight L7 having high coherence which is emitted from the light source passes through the ladder slit 210, stripes L8 having large and small light amounts are formed at equal intervals.

Since in the first modification most of the light L7 is intercepted by the ladder slit 210, the utilization efficiency of the light of the first modification is lower than the irradiating unit of the embodiment shown in FIG. 14, however, the toner amount measurement can be performed by using a light source having a sufficient light amount.

Figure 17:
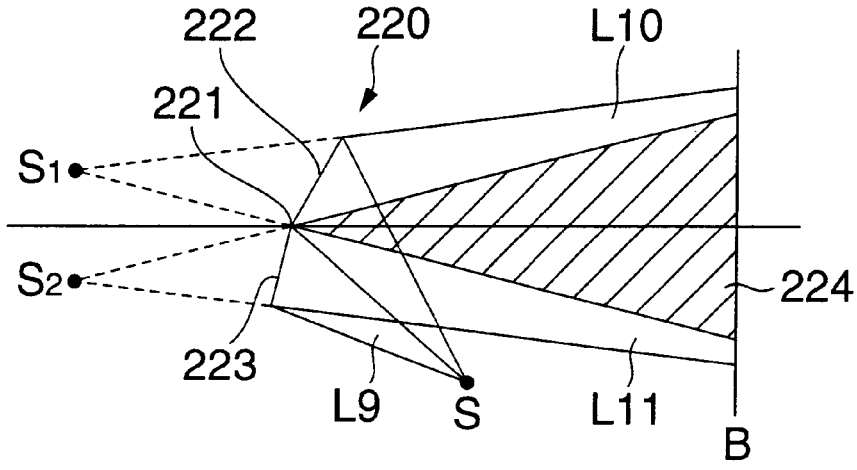
FIG. 17 is a diagram showing a second modification.

FIG. 17 is a diagram showing a second modification of the irradiating unit.

The second modification of the irradiating unit is equipped with a mirror 220 having two reflection surfaces 222, 223 which are disposed so as to be adjacent to each other through a boundary line 221 in a concave shape (e.g., in a V shape), and a laser light source S for emitting laser beams. A flux of laser beams L9 emitted from the laser light source S is divided by the boundary line 221 of the mirror 220, and the light fluxes L10, L11 thus divided are reflected by the reflection surfaces 222, 223 between which the boundary line 221 is sandwiched, whereby the fluxes L10 and L11 interfere with each other.

The two light fluxes L10, L11 reflected from the two reflection surfaces 222, 223 travel as if they are emitted from two light sources S1, S2. These light fluxes L10, L11 interfere with each other in an area 224 in which they cross each other, and interference fringes occur on the plane B.

These modifications may be used as the irradiating unit of the present invention. However, the irradiating unit having an obtuse-angled prism is used in the embodiment shown in FIG. 14 in consideration of a high utilization efficiency of light and an easy layout in the toner amount measuring unit.

The description on the embodiment of the irradiating unit having the obtuseangled prism will be described again.

Figure 18:
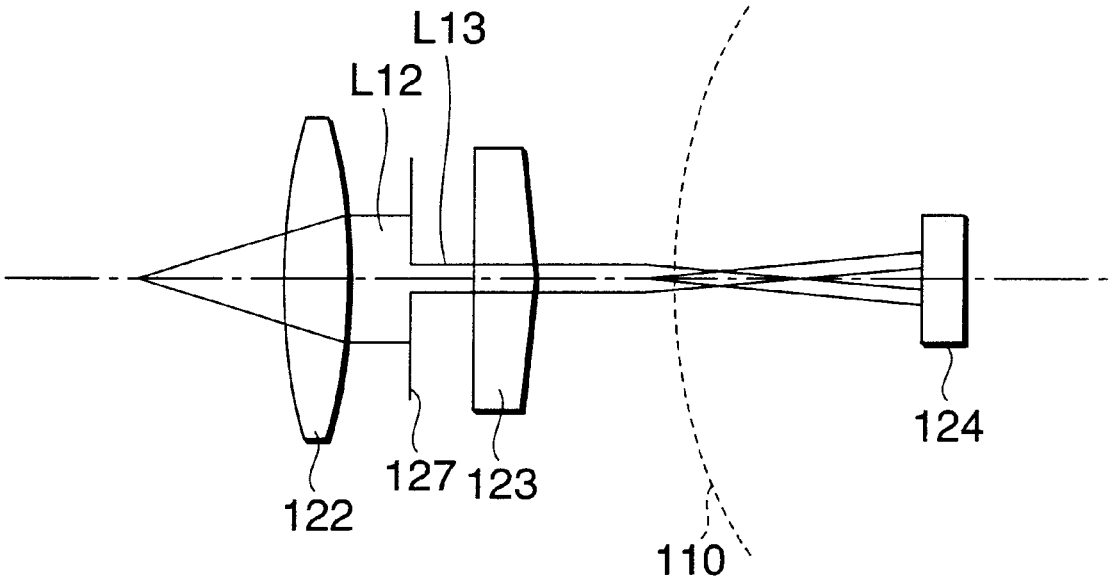
FIG. 18 is a diagram showing the detailed arrangement of an irradiating unit having an obtuse-angled prism and an optical sensor which is viewed from a longitudinal direction of the surface of the photosensitive roll.
Figure 19:
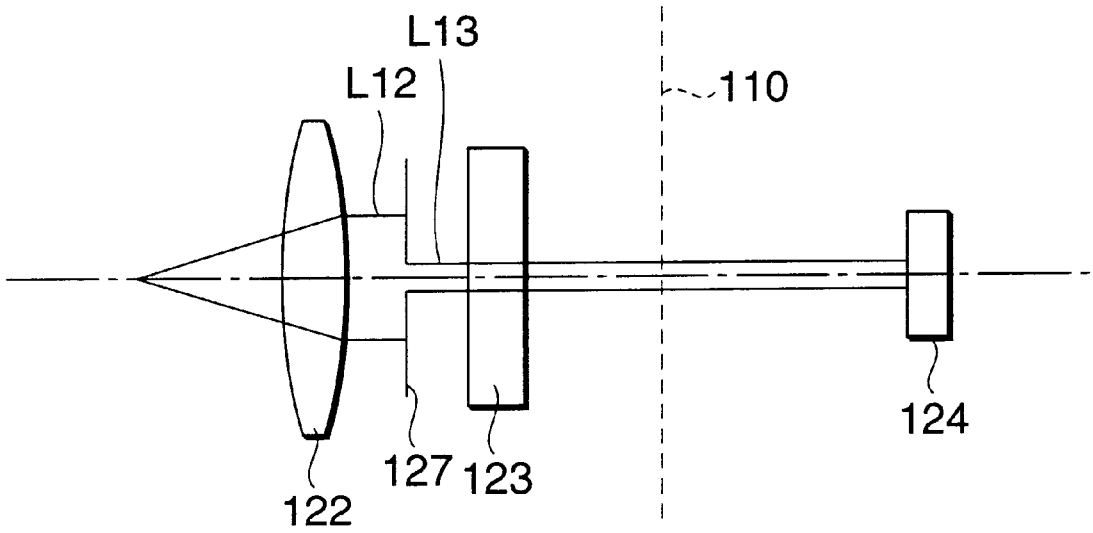
FIG. 19 is a diagram showing the detailed arrangement of an irradiating unit having an obtuse-angled prism and an optical sensor which is viewed from the moving direction of the surface of the photosensitive roll.

FIG. 18 is a diagram showing the detailed arrangement of the irradiating unit having the obtuse-angled prism and the optical sensor which is viewed from the longitudinal direction of the photosensitive roll, and FIG. 19 is a diagram showing the arrangement of FIG. 18 which is viewed from the moving direction of the surface of the photosensitive roll. In these figures, the light to be reflected from the photosensitive roll 110 is illustrated as if it passes through the surface of the photosensitive roll 110.

The irradiating unit of this embodiment has a laser beam source for emitting laser beams, and a diaphragm 127 for limiting a light flux L12 of laser beams emitted from the laser beam source. The interference fringes are formed by using the flux of laser beams L13 which is limited by the diaphragm 127. The effect of the diaphragm 127 will be described later.

As described above, the laser beams emitted from the laser diode 121 shown in FIG. 14 are collimated by the collimating lens 122, and then limited by the diaphragm 127. Thereafter, the flux of laser beams thus limited is incident to the obtuse-angled prism 123, and interference fringes are formed so as to cross the moving direction of the surface of the photosensitive roll 110. In this case, the arrangement is set so that the light flux portion providing the highest conversion efficiency to the interference fringes impinges against the surface of the photosensitive roll 110, and the light reflected from the surface of the photosensitive roll 110 is detected by the first optical sensor 124.

Viewed from the moving direction of the surface of the photosensitive roll 110, the obtuse-angled prism 123 makes the light travel in a straight line. Therefore, the interference fringes become fringes which are parallel to the longitudinal direction of the photosensitive roll 110.

Next, the effect of the diaphragm 127 will be described.

Figure 20:
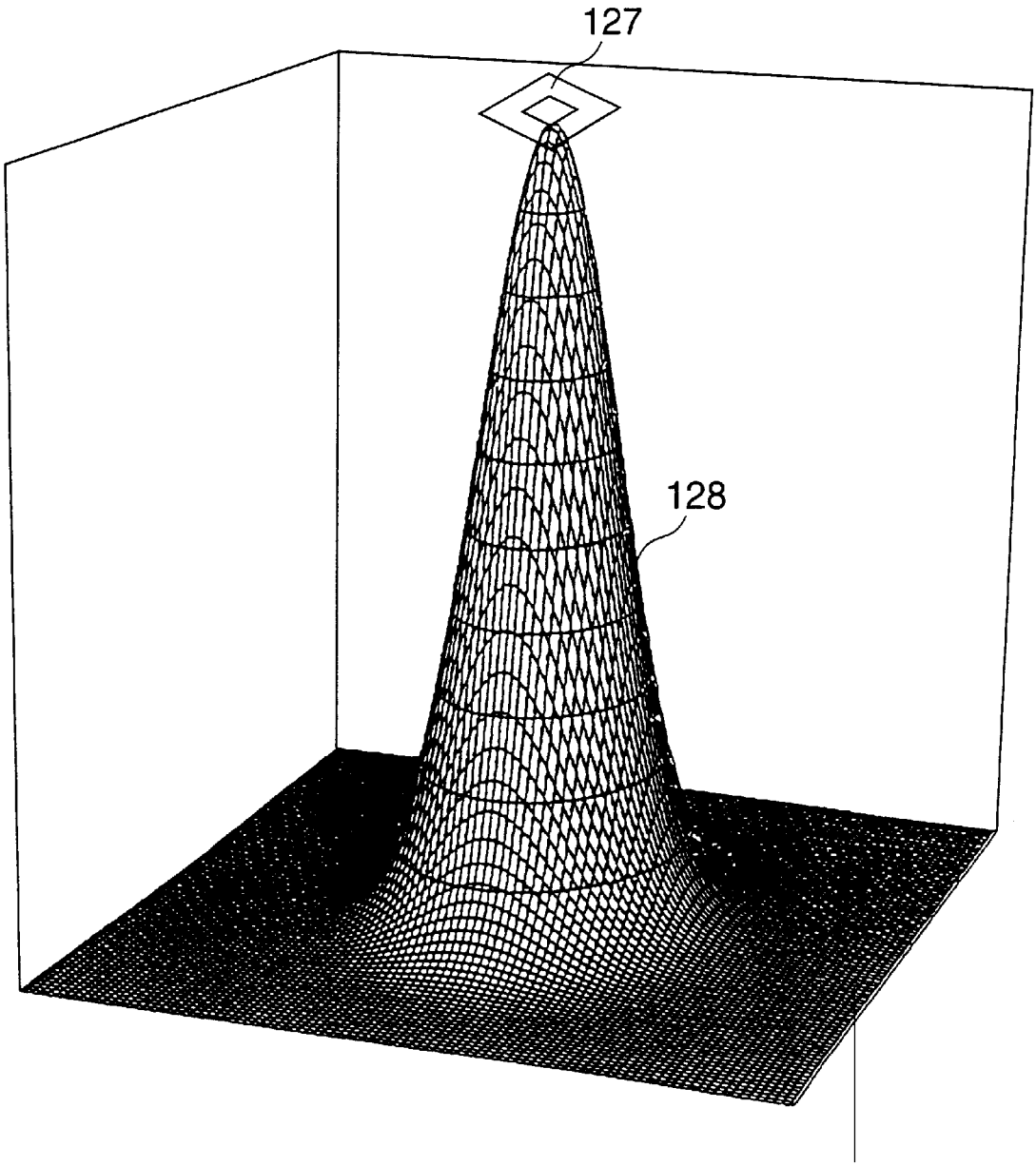
FIG. 20 is a diagram showing a light amount distribution in flux of light emitted from a laser diode.
Figure 21:
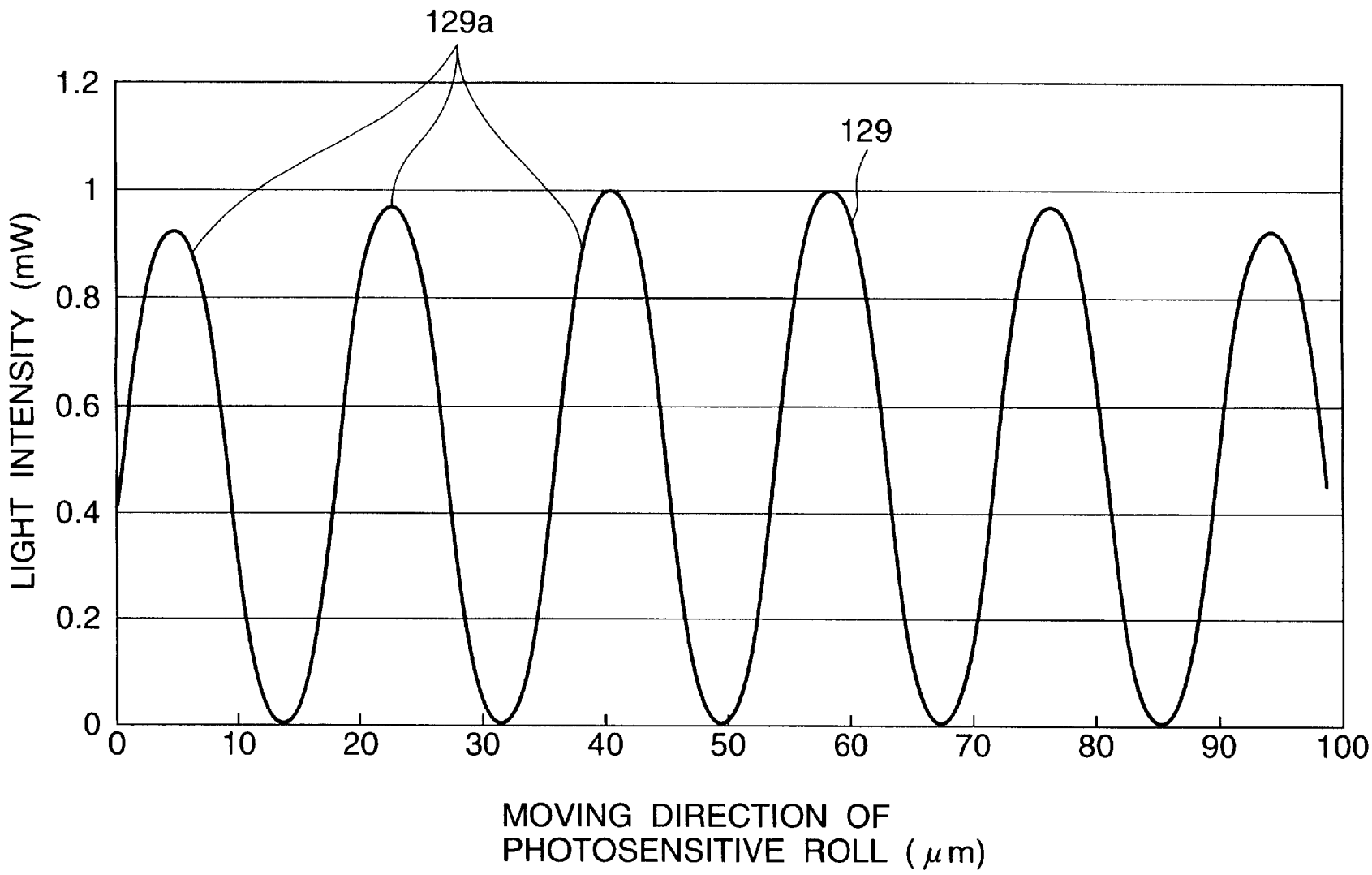
FIG. 21 is a diagram showing a light amount distribution of interference fringes which are formed by light having the light amount distribution shown in FIG. 20.

FIG. 20 is a diagram showing the light amount distribution in the flux of laser beams emitted from the laser diode, and FIG. 21 is a diagram showing the light amount distribution of interference fringes formed by using the flux of laser beams having the light amount distribution shown in FIG. 20.

Specifically, FIG. 20 shows the light amount distribution 128 in the flux of laser beams emitted from the laser diode, and the light amount distribution 128 is a so-called Gaussian profile having a round peak at the center portion of the light flux. Therefore, when interference fringes are formed by directly using laser beams emitted from the laser diode, plural light amount peaks 129*a* arranged in the moving direction of the photosensitive roll are different in intensity as indicated by a curved line 129 of FIG. 21, which is estimated to cause reduction of the precision of the toner amount measurement.

Therefore, in this embodiment, by limiting the light flux with the diaphragm 127 as shown in FIG. 20, the light beams at only the round tip (peak) portion of the light amount distribution 128 are passed through the diaphragm 127, so that the uniformity of the light amount of the interference fringes is enhanced. As a result, the measuring precision of the toner amount measurement is expected to be enhanced.

In the above-described embodiment, the predetermined frequency component is extracted from the output signal of the optical sensor by performing the frequency analysis. The extracting unit of the present invention may extract the frequency component by using a filter or the like.

Further, in the above-described embodiment, the fringes of light are formed in the direction perpendicular to the moving direction of the image forming body, however, the fringes of light may intersect to the moving direction of the image forming body at any angle insofar as the fringes cross the moving direction of the image forming body. However, the fringes of light are required to cross the moving direction of the image forming body at such a sufficient angle that the passage of the toner particles through the fringes of light increases/reduces the light amount.

In the above-described embodiment, the toner amount measuring unit contains the analysis circuit, however, the frequency analysis of the output signal of the optical sensor may be carried out by the controller 130 shown in FIG. 13. When the frequency analysis is carried out by the controller 130, the controller 130 is conceptualized to serve as both the controller and the extracting unit of the present invention.

Further, the embodiment shown in FIG. 14 is equipped with the first optical sensor 124 for detecting a minute amount of toner, and the second optical sensor 126 for detecting a large amount of toner. However, the toner amount measuring apparatus of the present invention may be equipped with only one optical sensor for detecting a minute amount of toner, or only a single optical sensor for detecting both a minute amount of toner and a large amount of toner. When both of a minute amount of toner and a large amount of toner are measured by using only one optical sensor, a minute amount of toner can be measured by conducting the frequency analysis of the output signal of the optical sensor as described above, and also a large amount of toner can be measured by making a data sampling timing of the optical sensor coincident with the frequency of the frequency component due to the interference fringes as described above to offset the frequency component.

As described above, according to the toner amount measuring apparatus of the present invention, a minute amount of toner which causes "residual toner" or "fog" can be measured with high precision. Further, according to the image forming apparatus of the present invention, an image can be formed with high image quality.

The entire disclosure of Japanese Patent Application No. 2000-097221 filed on Mar. 31, 2000 including specification, claims, drawings and abstract is incorporated herein by reference in its entirety.

What is claimed is:

1. A toner amount measuring apparatus which detects reflection light reflected from an image forming body on which an image is formed by toner to measure the amount of the toner, the apparatus comprising:

an irradiating unit which irradiates the image forming body with light to form fringes of light on the image forming body; and a photodetecting unit which detects reflection light obtained by reflecting the light forming the fringes from the image forming body.

2. The toner amount measuring apparatus as claimed in claim 1, wherein the image forming body is moved in a predetermined direction while toner is carried on the image forming body, the irradiating unit forms fringes of light in a direction crossing the predetermined direction on the image forming body, the photodetecting unit outputs a photodetection signal in accordance with the light amount detected, and the toner amount measuring apparatus further comprises an extracting unit for extracting a signal component having a predetermined frequency from the photodetection signal output from the photodetecting unit.

3. The toner amount measuring apparatus as claimed in claim 1, wherein the irradiating unit forms interference fringes as the fringes.

4. The toner amount measuring apparatus as claimed in claim 3, wherein the irradiating unit comprises:

a prism having two refraction surfaces which are disposed to be adjacent to each other on opposite sides of a ridgeline in a convex shape; and a laser beam source for emitting a laser beam, and wherein a light flux of the laser beam emitted from the laser beam source is divided by the ridgeline of the prism, and the light fluxes thus divided are refracted by the two refractive surfaces between which the ridgeline is sandwiched, whereby the light fluxes interfere with each other.

5. The toner amount measuring apparatus as claimed in claim 4, wherein the angle of the prism is set to a value substantially in the range from 160 to 179 degrees.

6. The toner amount measuring apparatus as claimed in claim 3, wherein the irradiating unit comprises:

a mirror having two reflection surfaces which are disposed to be adjacent to each other on opposite sides of a boundary line in a concave shape; and a laser beam source for emitting a laser beam, and wherein a light flux of the laser beam emitted from the laser beam source is divided by the boundary line of the mirror, and the light fluxes thus divided are reflected by the two reflection surfaces between which the boundary line is sandwiched, whereby the light fluxes interfere with each other.

7. The toner amount measuring apparatus as claimed in claim 3, wherein the irradiating unit comprises:

a laser beam source for emitting a laser beam; and a diaphragm for limiting a light flux of the laser beam emitted from the laser beam source, the interference fringes being formed by the light flux of the laser beam limited by the diaphragm.

8. The toner amount measuring apparatus as claimed in claim 3, wherein the pitch of the interference fringes is four times or more as large as the particle size of toner particles.

9. The toner amount measuring apparatus as claimed in claim 1, wherein the light source of the irradiating unit emits coherent light.

10. The toner amount measuring apparatus as claimed in claim 9, wherein the light source is a laser beam source.

11. The toner amount measuring apparatus as claimed in claim 1, wherein the irradiating unit comprises:

a light source;

a lens; and one of a prism and a ladder slit, and the photodetecting unit comprises:

a photodetecting sensor, the irradiating unit and the photodetecting unit being disposed in a holder.

12. The toner amount measuring apparatus as claimed in claim 1, wherein the irradiating unit is a ladder slit.

13. An image forming apparatus which finally forms a toner image on a sheet under a controllable image forming condition, the apparatus comprising:

an image forming body which carries toner to form the toner image thereon;

a toner amount measuring unit which comprises an irradiating unit for irradiating the image forming body with light to form fringes of light on the image forming body and a photodetecting unit for detecting reflection light obtained by reflecting the light forming the fringes from the image forming body, and measures the amount of the toner carried on the image forming body; and a condition controlling unit for controlling the image forming condition on the basis of the toner amount measured by the toner amount measuring unit.

14. A toner amount measuring method comprising the steps of:

irradiating an image forming body with light to form fringes of light thereon;

detecting the light forming the fringes reflected from the image forming body and outputting a photodetection signal in accordance with the amount of the light thus detected; and extracting a signal component having a specific frequency from the photodetection signal.

15. The toner amount measuring method as claimed in claim 14, wherein the signal component having the specific frequency is extracted by using Fourier Transform.

* * * * *